United States Patent [19]

Petersson

[11] 4,178,731

[45] Dec. 18, 1979

[54] ROOF COVERING

[75] Inventor: Bengt O. Petersson, Kungsbacka, Sweden

[73] Assignee: Bengt Petersson New Products Investment AB, Gothenburg, Sweden

[21] Appl. No.: 852,912

[22] Filed: Nov. 18, 1977

[30] Foreign Application Priority Data

Mar. 22, 1977 [DE] Fed. Rep. of Germany ..... 7708919

[51] Int. Cl.[2] ..... E04D 1/34

[52] U.S. Cl. ..... 52/520; 52/545

[58] Field of Search ..... 52/520, 545, 521, 547, 52/543, 549, 478, 489

[56] References Cited

U.S. PATENT DOCUMENTS

| | | | |
|---|---|---|---|
| 297,862 | 4/1884 | Smith | 52/520 |
| 1,539,632 | 5/1925 | Belding | 52/520 |
| 2,128,495 | 8/1938 | Murphy | 52/520 |
| 3,320,711 | 5/1967 | Johnson | 52/547 X |
| 4,040,211 | 8/1977 | Wotherspoon | 52/520 X |

FOREIGN PATENT DOCUMENTS

| | | | |
|---|---|---|---|
| 77985 | 9/1949 | Czechoslovakia | 52/520 |
| 817238 | 7/1959 | United Kingdom | 52/520 |

*Primary Examiner*—J. Karl Bell

[57] ABSTRACT

Roof covering comprising a number of surface covering sheet metal strips and a number of fastening elements to be fastened to a foundation structure and to grip over the respective sheet metal strips and thereby hold them in place against the foundation structure. The surface covering sheet metal strips are highly profiled into a wave shape extending in the longitudinal direction of the strips with a wave length, which is of the same order as the width of each strip which has raised portions and countersunk portions as seen from the intended upper side of the strip and bent edge portions extending along the longitudinal edges of the strip. One bent edge portion has a portion extending in outwards direction from said upper side and preferably a subsequently following portion, which is parallel to the principal surface of the strip. The other edge portion has a portion extending in direction away from the principal surface and preferably is followed by a portion parallel to the principal surface. Said edge portions are arranged to overlap each other, when a number of strips are laid close to each other in order to form coverings. Said fastening elements are arranged with a U-shaped portion to grip over the underlying edge portion of the edge portions overlapping each other and with an outer portion to grip over the outermost portion of the edge portion of the overlying edge. The fastening elements are arranged to cooperate with the edge portions of the strips at the counter sunk portions of the strips.

1 Claim, 4 Drawing Figures

ROOF COVERING

The present invention relates to a roof covering comprising a number of surface covering sheet metal strips and a number of fastening elements to be fastened to a foundation structure and to grip over the respective sheet metal strips and thereby hold them in place against the foundation structure.

It is known to use sheet plate as a roof covering material in the form of large sheets as well as stamped out plates. However, the material has certain drawbacks. By way of example strong noise effects arise in connection with rain. Noise effects also manifest themselves in the form of clicks in connection with movements caused by heat. In addition great professional skill is in most cases necessary when covering with sheet material, because of the fact that seaming, welding or riveting are included in the covering operation.

It is an object of the present invention to provide a roof covering of sheet metal, which is made in such a manner that strong noise effects in connection with rain and movements caused by heat are avoided.

It is another object to provide a roof covering, which is very easy to lay on different surfaces without having to resort to working methods requiring persons skilled in the art.

It is a further object of the invention to provide a roof material of high aesthetic quality obtained by means of rythmically repeated forming elements.

The objects mentioned are obtained by means of a roof covering according to the present invention which is characterized in that the surface covering sheet metal strips are highly profiled into a wave shape extending in the longitudinal direction of the strips with a wave length, which is of the same order as the width of each strip, which has raised portions and countersunk portions as seen from the intended upper side of the strip, and bent edge portions extending along the longitudinal edges of the strip, of which bent edge portions one has a portion extending in outwards direction from said upper side and preferably a subsequently following portion, which is parallel to the principal surface of the strip, while the other edge portion has a portion extending in direction away from the principal surface and preferably is followed by a portion parallel to the principal surface, said edge portions being arranged to overlap each other, when a number of strips are laid close to each other in order to form coverings. The fastening elements are arranged with a U-shaped portion to grip over the underlying edge portion of the edge portions overlapping each other and with an outer portion to grip over the outermost portion of the edge portion of the overlying edge, the fastening elements being arranged to cooperate with the edge portions of the strips at the countersunk portions of the strips.

Figure 1:
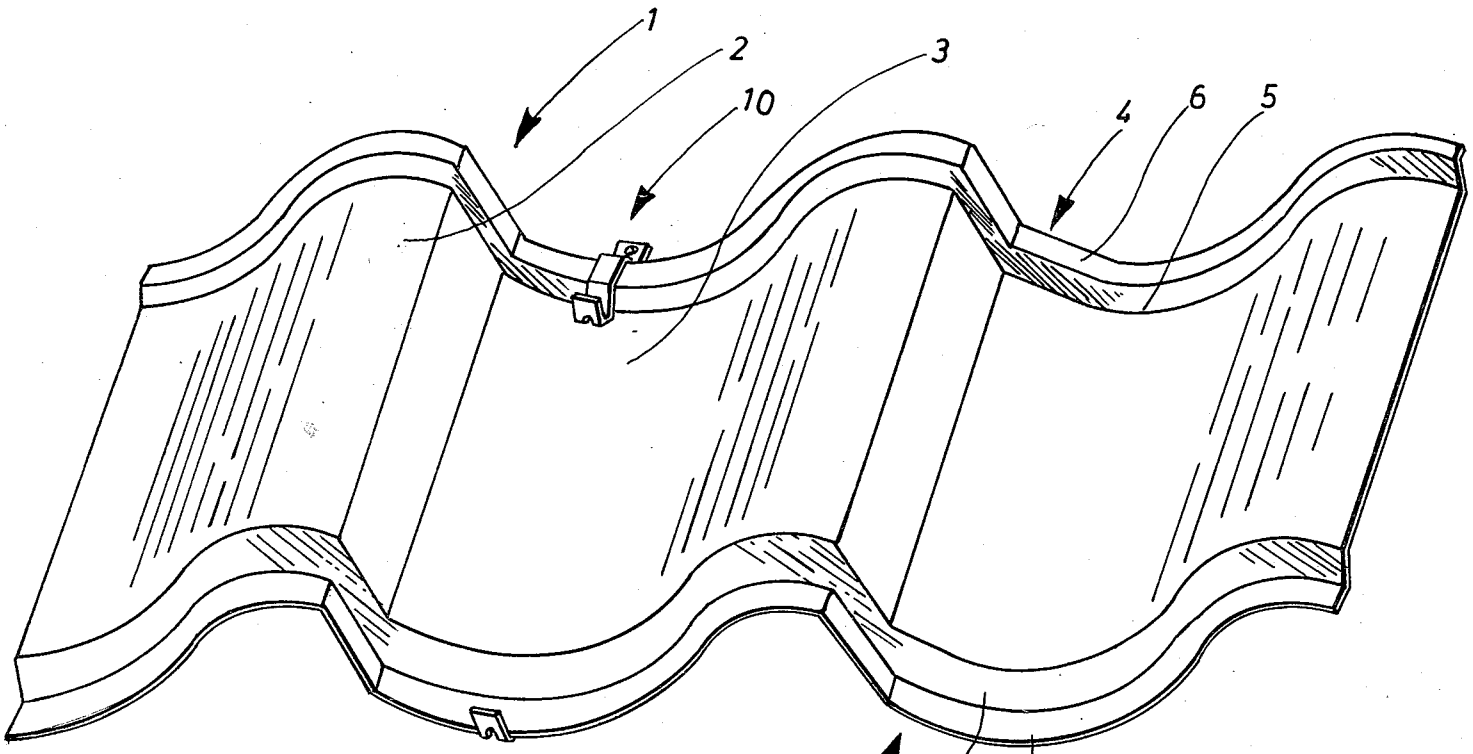
Figure 2:
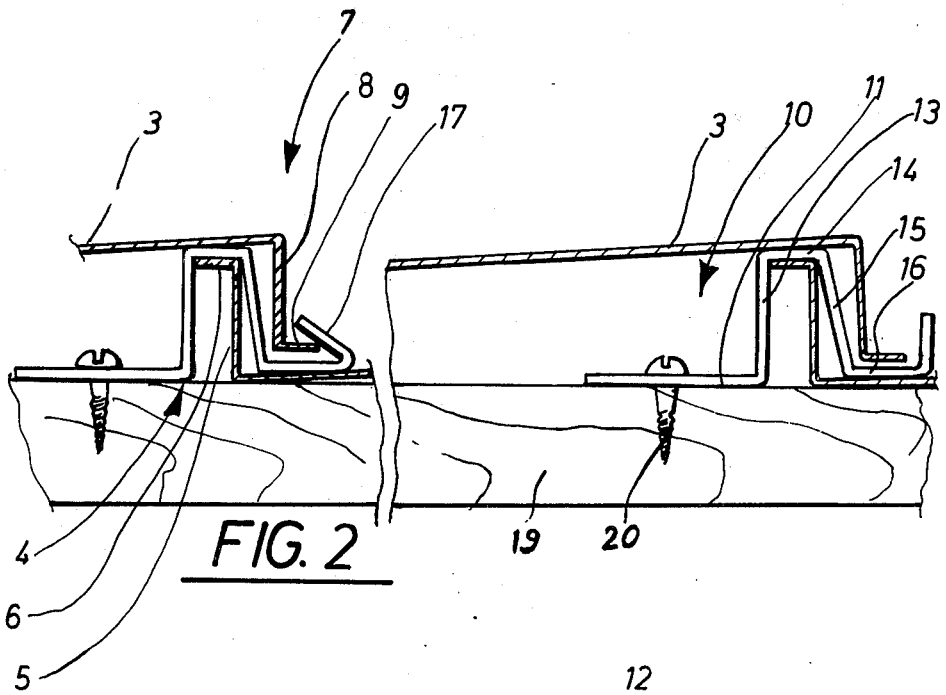
Figure 3:
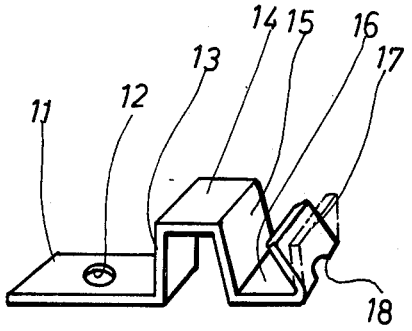
Figure 4:
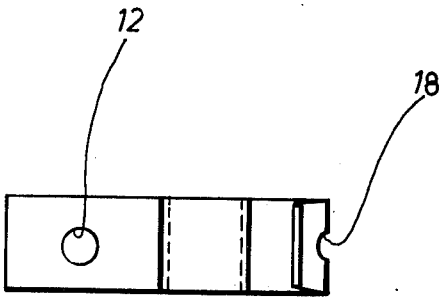

An embodiment of the invention is illustrated in the accompanying drawings, in which FIG. 1 shows a portion of a roof covering, FIG. 2 is a broken cross sectional view of a roof covering and FIGS. 3 and 4 are views of a fastening means, forming part of the roof covering assembly, as seen in perspective and top view respectively.

The roof covering comprises two kinds of main elements, one of which is a surface covering element 1 in the form of sheet metal strips, which are shaped with raised portions 2 and countersunk portions 3, which in undulating fashion alternate along the length of the strip. The number of portions 2 and 3 depends upon the length of the strip, which is adapted to a suitable manageability in connection with the laying operation. The strip 1 has an upper edge with a bent portion 4 comprising a part 5 extending from the intended upper side of the portions 2, 3 and an edge portion 6 extending parallel to the portions 2, 3. The opposite edge of the strip 1 has a portion 7 with a part 8 extending in opposite direction to the part 5, thus downwards from the upper side, and an edge portion 9, which is parallel to the portions 2, 3. This is clearly evident from FIG. 2.

The wave shape of the raised portions 2 and countersunk portions 3 of the element 1 is in this connection of great importance as is also the case with the width of the element. Thus, as distinguished from conventional materials the roof covering according to the invention does not comprise large sheets with a relatively low and short wave of trapezoid or sine shape. The waves instead have a considerable length and depth, while the width of the element is of the same order as the length of the wave. As typical measures the wave length of 200 millimetres, the wave height of 50 millimetres and the width of 350 millimetres can be mentioned. This gives the proportion of 4:2:7 between wave length, wave height and width of the element. By this arrangement both a great stiffness of the roof covering and a good result with regard to the elimination of sound effects caused by rain and movements due to heat are obtained as well as an easthetically attractive rythmic effect of design both in the longitudinal and the ascending direction of the roof. By means of the deep and long waves also an advantageous shadow effect is obtained, which can be still further accentuated by an assymmetrical design of the waves as is shown in FIG. 1.

The second kind of main elements consists of fastening elements 10 for the fastening of the strips 1. Each one of these fastening elements comprises a fastening portion 11 with a hole 12. Thereafter follows a portion 13 forming a right angle to the portion 11, and a portion 14 parallel to the portion 11, and further a portion 15, which is parallel to the portion 13, which three portions form a U-shape. A portion 16 positioned in line with the portion 11 and a portion 17 which in the manufactured condition is parallel to the portion 14, terminates the fastening element. In the bending angle between the portions 16 and 17 a hole 18 is made. As is evident from FIG. 2, the fastening elements 10 are provided to be fastened to the foundation structure 19 by means of screws 20 or other type of fastening means. The design of the fastening elements depends upon the foundation structure 19, in case of wood, screws or nails being suitable, while a foundation structure of metal profiles may require the use of rivets, screws and nuts or welding.

When covering a roof, which is symbolized by a foundation structure 19 in FIG. 2, and which is assumed to be inclined in downwards direction to the right in FIG. 2, several strips are laid close together. In this operation they are laid in such a manner that the edge portion 7 is pointing downwards overlapping the edge portion 4 of the strip positioned below.

In the laying operation one starts with the lower edge of the roof, where a number of fastening elements 10 are fastened. The first strip 1 is now laid with its portion 9 resting between the portions 15 and 17 of the fastening elements. Thereafter a new row of fastening elements is fastened at the upper edge 4, and each such element shall with its portion 14 overlap the portion 6 of the strip 1. All fastening elements according to FIG. 1 are placed at the portion 3 of the strip, thus in the lowest portion, which is the portion resting against the foundation structure, while the portion 2 is at a distance from the same. The first mentioned row of fastening elements is now knocked down on the portion 9 of the strip by means of the parts 17, as is shown to the left in FIG. 2. By this operation the first strip is effectively held in place.

The next strip is now in the same manner with its portion 9 resting between the portions 15 and 17 laid out in the second row of fastening elements and is with its upper edge fastened by a new row of fastening elements. The portions 17 of the second row of fastening elements are now knocked down round the portion 9 of the second strip, whereby the latter is held in place. In order to facilitate the knocking down of the portion 17, the hole 18 is made, so that thereby the cross section of the bent portion is reduced.

Utilizing the design with the deep profiling, the strips 1 acquire a great stiffness, whereby they are resistant against wind force and the weight of snow deposits. At the same time they can be made with a small width, whereby the movements caused by heat will be unimportant. Because of the stiffness it is sufficient, if one fastens the strips at points relatively far apart, thus only at the countersunk portions 3, whereby the fastening work is facilitated at the same time as only limited requirements have to be made with regard to the foundation structure, which by way of example can exclusively comprise battens. The deep profiling also contributes to a reduction of the resonance of noise, by way of example caused by rain drops, whereby any annoying sound effects need not arise. It may finally be observed that the roof covering will be aesthetically pleasant because of the absence of plane portions.

I claim:

1. Roof covering comprising a number of surface covering sheet metal strips and a number of fastening elements to be fastened to a foundation structure and to grip over the respective sheet metal strips and thereby hold them in place against the foundation structure, said surface covering sheet metal strips being highly profiled into a wave shape extending in the longitudinal direction of the strips with a wave length which is of the same order as the width of each strip, said wave shape having raised portions and countersunk portions as seen from the intended upper side of the strip and bent edge portions extending along the longitudinal edges of the strip, one of said bent edge portions having a portion extending in outwardly direction from said upper side and preferably a subsequently following portion which is parallel to the principal surface of the strip, while the other edge portion has a portion extending in an opposite direction away from the principal surface and preferably is followed by a portion parallel to the principal surface, said edge portions being arranged to overlap each other when a number of strips are laid close to each other in order to form coverings, said fastening elements each being arranged with a first portion adapted to be secured to the foundation structure, a second U-shaped portion to grip over the underlying edge portion of the edge portions overlapping each other and with a third outer portion constructed to form a bending angle therein and adapted to grip over the following portion of the overlying edge portion of the edge portions overlapping each other after the mounting of the same by means of a downwards bending operation, said bending angle being positioned at a distance from the edge of said following portion of the overlying edge portion, and the fastening elements being arranged to cooperate with the edge portions of the strips at the countersunk portions of the strips, whereby said second portion of the fastening element fixes the underlying edge portion against movements in the transverse direction of the strips and forms a support for the overlying edge portion, and said position of the bending angle of said third portion of said fastening element permits movements of the strip at the edge of its overlying edge portion.

* * * * *